US011864675B2

(12) United States Patent
Flores Sanchez

(10) Patent No.: US 11,864,675 B2
(45) Date of Patent: Jan. 9, 2024

(54) HANGER-TEMPLATE FOR FOLDING AND HANGING ITEMS OF CLOTHING

(71) Applicant: HangFold GmbH, Lucerne (CH)

(72) Inventor: Juan Antonio Flores Sanchez, Zurich (CH)

(73) Assignee: HANGFOLD GMBH, Lucerne (CH)

( * ) Notice: Subject to any disclaimer, the term of this patent is extended or adjusted under 35 U.S.C. 154(b) by 240 days.

(21) Appl. No.: 17/414,167

(22) PCT Filed: Oct. 14, 2019

(86) PCT No.: PCT/ES2019/070697
§ 371 (c)(1),
(2) Date: Jun. 15, 2021

(87) PCT Pub. No.: WO2020/148465
PCT Pub. Date: Jul. 23, 2020

(65) Prior Publication Data

US 2022/0079364 A1 Mar. 17, 2022

(30) Foreign Application Priority Data

Jan. 16, 2019 (ES) ..... ES201930024

(51) Int. Cl.
*A47G 25/40* (2006.01)
*D06F 89/02* (2006.01)

(52) U.S. Cl.
CPC ..... *A47G 25/4061* (2013.01); *D06F 89/023* (2013.01)

(58) Field of Classification Search
CPC .... A47G 25/40; A47G 25/4061; D06F 89/023
(Continued)

(56) References Cited

U.S. PATENT DOCUMENTS 2,605,942 A * 8/1952 Warren ..... A47G 25/4023 223/89
2,728,499 A * 12/1955 Mueller ..... A47G 25/4023 223/94

(Continued)

FOREIGN PATENT DOCUMENTS

DE 29920563 U1 5/2001
GB 1314168 A 4/1973

(Continued)

OTHER PUBLICATIONS

International Search Report, issued in PCT/ES2019/070697 dated Jan. 31, 2020, 6 pages.

*Primary Examiner* — Nathan E Durham
(74) *Attorney, Agent, or Firm* — Rothwell, Figg, Ernst & Manbeck, P.C.

(57) ABSTRACT

A hanger for folding and hanging items of clothing, collapsible and articulated, which transforms into a template to facilitate the folding, transport and storage of shirts, T-shirts and other items of clothing. It comprises a flat support (1), attached to the hanging hook (2), and comprising two divergent arms (3) featuring corresponding longitudinal guides (5); wherein each lateral extension (6) is L-shaped with a short side (61) whose extremity is movable along the corresponding guide (5), and the long side (62) and a base (8) forming the two shoulders of the hanger, and which is articulated to the vertices of both extensions (6). It features a folded position wherein the two long sides (62) are aligned or superimposed and the base (8) is next to the flat support (1), and an extended position wherein the two long sides (62) are disposed parallel to each other.

10 Claims, 4 Drawing Sheets

(58) Field of Classification Search
USPC ..... 223/89, 90, 94
See application file for complete search history.

(56) References Cited

U.S. PATENT DOCUMENTS

| | | | | | |
|---|---|---|---|---|---|
| 3,874,572 | A * | 4/1975 | McClenning | A47G 25/4053 | D6/318 |
| 4,717,053 | A * | 1/1988 | Wang | A47G 25/4053 | 223/94 |
| 5,154,329 | A * | 10/1992 | Dorfmueller | B65D 85/182 | 206/293 |
| 5,893,493 | A * | 4/1999 | Noiray | A47G 25/4061 | 223/89 |
| 6,105,835 | A | 8/2000 | Hatakeyama | | |
| 6,279,791 | B1 * | 8/2001 | Betman | B65D 85/182 | 223/37 |

FOREIGN PATENT DOCUMENTS

| | | | |
|---|---|---|---|
| JP | H7-14965 | U | 3/1995 |
| JP | H10-57206 | A | 3/1998 |
| JP | 2011-67577 | A | 4/2011 |

* cited by examiner

Fig. 1
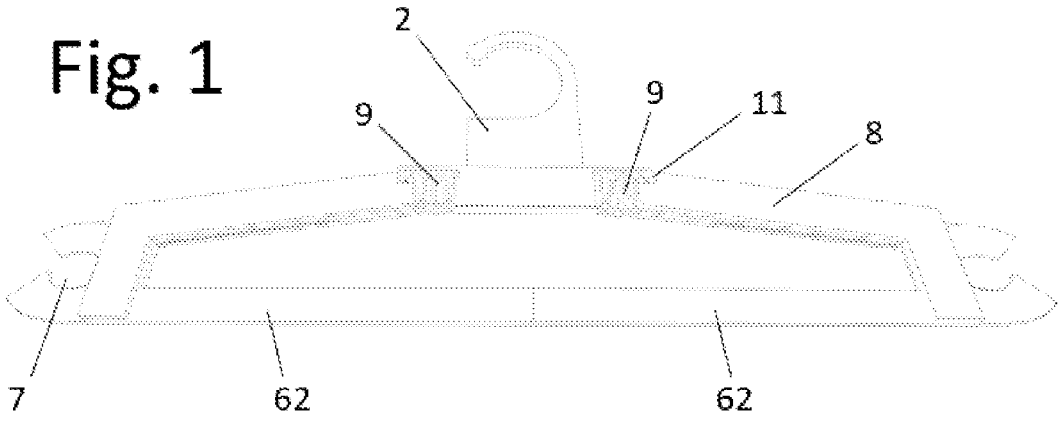
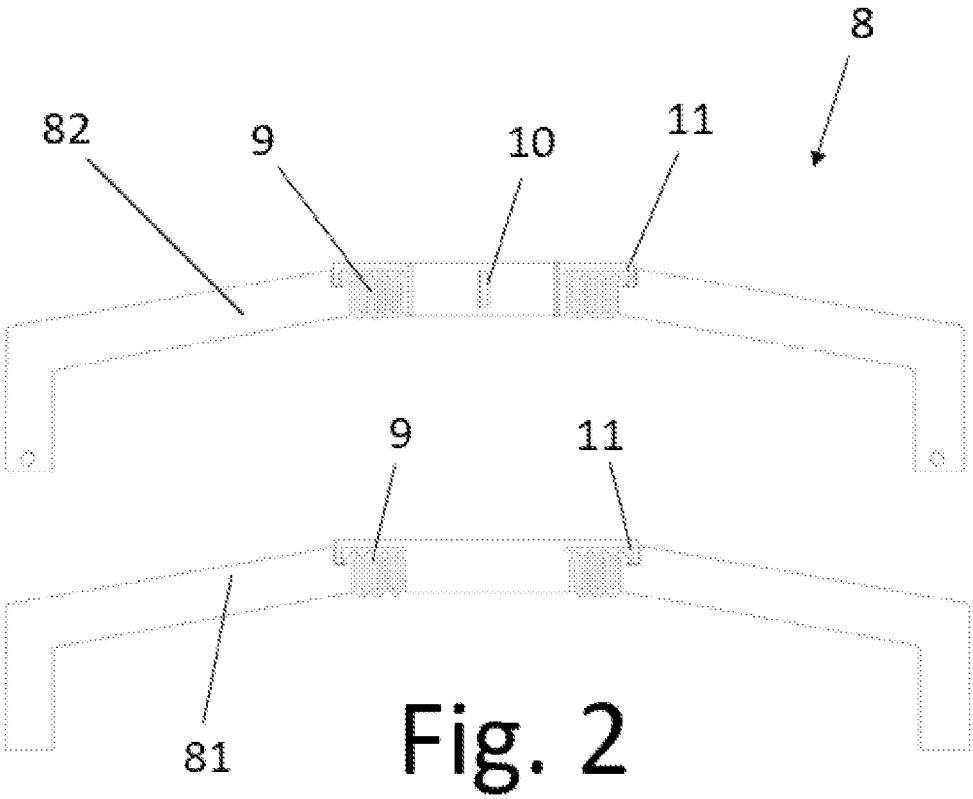
Fig. 2

HANGER-TEMPLATE FOR FOLDING AND HANGING ITEMS OF CLOTHING

This application is a 35 U.S.C. 371 National Phase Entry Application from PCT/ES2019/070697, filed Oct. 14, 2019, which claims priority to Spanish Patent Application No. P201930024, filed Jan. 16, 2019, which are incorporated herein by reference in their entireties.

FIELD OF THE INVENTION

This invention refers to a hanger and template for folding and hanging items of clothing for the upper part of the body.

The invention refers, in general, to hangers for items of clothing, more specifically to hangers intended to facilitate, by means of the use of a template, correct folding, transport and storing of items of clothing for the upper part of the body, such as shirts, blouses, T-shirts, jerseys, jackets, etc.

It is applicable to the field of clothing and other ancillary fields, such as the storage and transport of clothing.

STATE OF THE ART

The need to travel has grown considerably over the last few years, especially for work purposes. With it has grown the need for a method or an element that facilitates the hanging, storage and folding of items of clothing.

Hangers for items of clothing have existed for centuries and developments and inventions in this area have been focused on four main groups:

- The material and the method used for manufacturing the hangers.
- The expansion of hanging options and the type of clothing that can be hung on hangers.
- The inclusion of functionalities intended to prevent or remove creases from garments.
- The mechanisation of hangers intended for transport and storage, both for hangers and garments.

Thus, utility model ES1045703U of ESGUVA GUTIERREZ, shows a cardboard hanger, ES1015619U adds clothes pegs and ES1051774U includes a bag for storing small garments such as lingerie.

Some hangers comprise movable or articulated elements. On the one hand, ES1078548U proposes a self-ironing hanger by means of a series of articulated parts that keeps the garment taut, preventing or removing creases. ES1018772U proposes a hanger that can be extended in its horizontal length to adapt to garments of different sizes, and equally, to prevent the formation of creases.

Without increasing the functions with respect to garments, ES260095U shows a hanger that can be folded on its central axis to facilitate storage and transport of the hanger. While ES2231914 T3 presents a hanger that facilitates folding the garment on its vertical axis (hip-neck), keeping the hanger inside the garment to be hung subsequently and transported in travel suitcases.

Notwithstanding, the persistent need is to reduce the time required to fold garments for the upper part of the body, such as shirts, to ensure that said garments are folded to the same size, thereby saving space in the packing of suitcases and preventing the creation of excessive creases.

The invention claimed herein has been developed to meet this unsatisfied need.

The applicant is not aware of any solution similar to the invention.

BRIEF EXPLANATION OF THE INVENTION

The invention consists of a hanger-template according to the claims.

This invention refers to a mechanised, foldable and articulated hanger system, to the elements and materials required for the creation of said system, and the use of these elements.

In the following description, the conjunction "or" should be deemed non-exclusive, allowing for the possibility of comprising all or several of the options listed.

Moreover, this invention provides the possibility of converting the hanger into a template which facilitates the folding action of the garment, said template being inside the item of clothing, but being easily removable in any preferred embodiment.

As will be seen below, the hanger of the invention has a particularly beneficial use for facilitating the packing of a travel suitcase. Notwithstanding, it is evident that the invention may be beneficial for any other application wherein there is a desire to hang an item of clothing by means of the use of a hanger, or fold a garment by means of the use of a folding template, for example, in the storage of clothing in a business, the packing of clothes for moving house, the folding of products in a company that manufactures clothing, the folding and storage of clothing in companies engaged in dry cleaning and laundry companies, the storage of items of clothing between seasons, etc.

The description of the preferred embodiment expressed herein intends to show the best manufacturing method, however, said explanation should be understood as an explanatory and illustrative contribution, but not limiting or exclusive.

Specifically, the hanger and template for folding and hanging items of clothing is of the type that has a hanging hook that defines an upper part of the hanger and two garment support shoulders. It also comprises two articulated lateral extensions at the ends of the shoulders. Each extension defines a long side, longer than the other dimension. Thus, the hanger has a folded position wherein the long sides are aligned or superimposed and an extended position wherein the long sides are disposed parallel and approximately separated by the width of the hanger.

The hook should be interpreted in the broadest possible sense, and could be a hook for a washer arranged on a wardrobe rail, as is common in hotels, changing room lockers, etc. The preferred embodiment comprises:

- A flat support, attached to the hanging hook and two divergent arms featuring corresponding longitudinal guides.
- The extensions, in this case, L-shaped. Each extension has a short side whose extremity is movable along the corresponding support guide and a long side.
- And a base forming the shoulders of the hanger, and which is articulated to the vertices of both extensions.

These three elements are configured so that the hanger has:

- A folded, or "hanger" position, wherein the long sides are aligned or superimposed, and the base is next to the support.
- An extended, or "template" position, wherein the long sides are disposed parallel and approximately separated by the width of the hanger.

This preferred solution can be supplemented with other functions.

In a first particular embodiment, the support has a first hinge on each side of the hanging hook and the base has second hinges coinciding with the first hinges in the folded position. In this way the hanger can reduce its effective width and be extracted through the neck of the garment.

The first hinges or the second hinges may have a return spring or a locking stop or latch.

Preferably, the long sides of the extensions are half the width of the hanger, and, more preferably, they are finished off at an angle.

It is preferred that the base facilitates and guides the movement of the hook, for which purpose it may have a guide groove along which a hook element slides.

The most preferred form of the base is formed in two parts forming the faces that embrace the extensions and the support.

Other variants will be described below.

DESCRIPTION OF THE DRAWINGS

For a better understanding of the invention, the following figures are included, which correspond to an example of a non-limiting embodiment.

FIG. 1: Perspective view of the hanger in the folded position

FIG. 2: View of the pieces or parts that form the faces of the base in the embodiment above.

DETAILED EXPLANATION OF AN EMBODIMENT OF THE INVENTION

Figure 3:
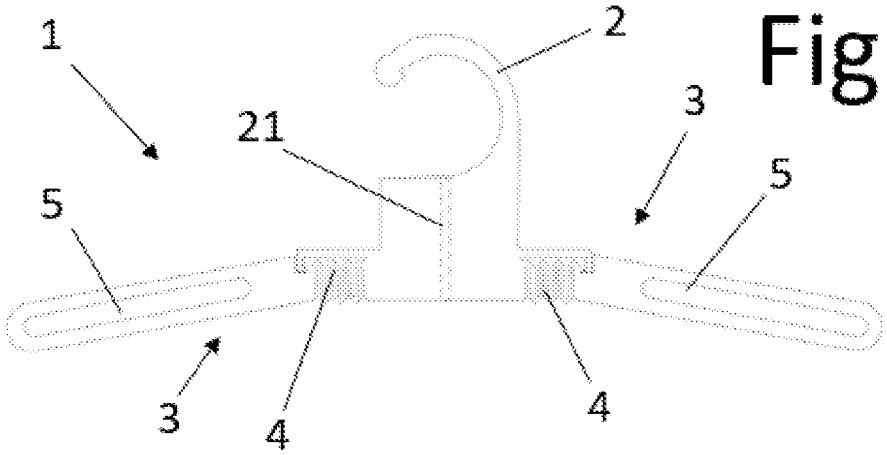
FIG. 3: Frontal view of the support.

The following is a brief description of an embodiment of the invention, as an illustrative and non-limiting example thereof.

The invention is based on a support (1), formed by an approximately flat body that comprises an upper hanging hook (2) from which two divergent arms (3) emerge, generally at an angle to each other, which are relatively short. This base (1) comprises a whole series of add-ons which make it particularly advantageous for its intended use.

Firstly, each arm (3) is connected to the upper hanging hook (2) by means of a first hinge (4), preferably formed by a return spring, which allows its position to be adjusted temporarily. Moreover, each arm (3) comprises a longitudinal guide (5), i.e., in its main direction. That guide (5) allows the movement and relevant rotation between the support (1) and both straight extensions (6), one per arm (3), attached to the same. The guide (5) may be a longitudinal orifice and the extensions (6) comprising a pin (not referenced) which circulates within the orifice.

Figure 4:
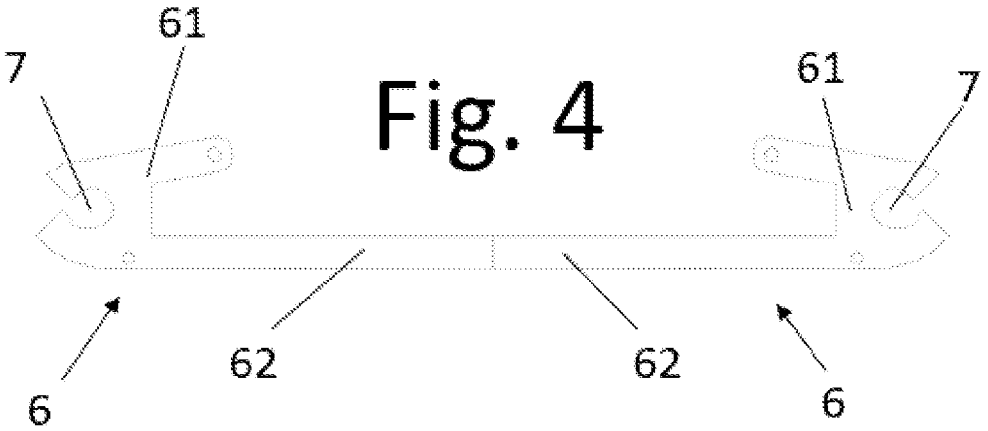
FIG. 4: Frontal view of the extensions of the example in FIG. 1.
Figure 5:
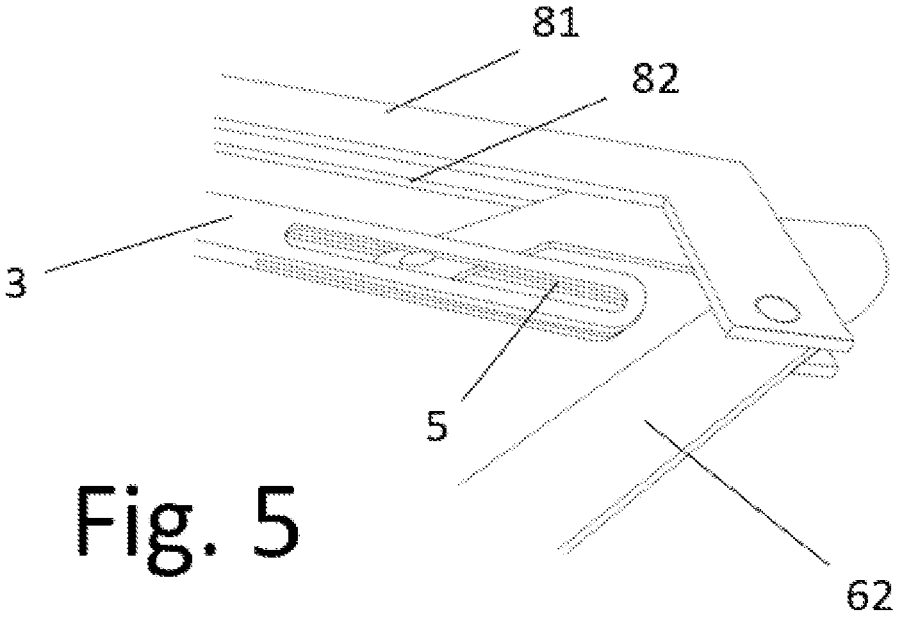
FIG. 5: Detail of the joint between the support, the base and one extension.

The preferred extensions (6) (FIG. 4) will be L-shaped, although the short side (61) may be curved or broken. The connection to the guide (5) is made through the end of this short side (61) of the L. On the outside part of the short side (61) of each extension (6) attachments for tapes or straps (7) may be included, formed, for example, by two circles with a circular section removed. For their part, the long sides (62) of each extension may be of a length equal to half the width of the hanger, so that they are aligned in the folded position, or of a length equal to the width of the hanger but slightly misaligned so that they are superimposed in the folded position. If the long sides (62) are aligned (FIG. 4), it is preferred that they are finished off at an angle, so that the contact acts as an inclined plane and they slide against each other.

Figure 7:
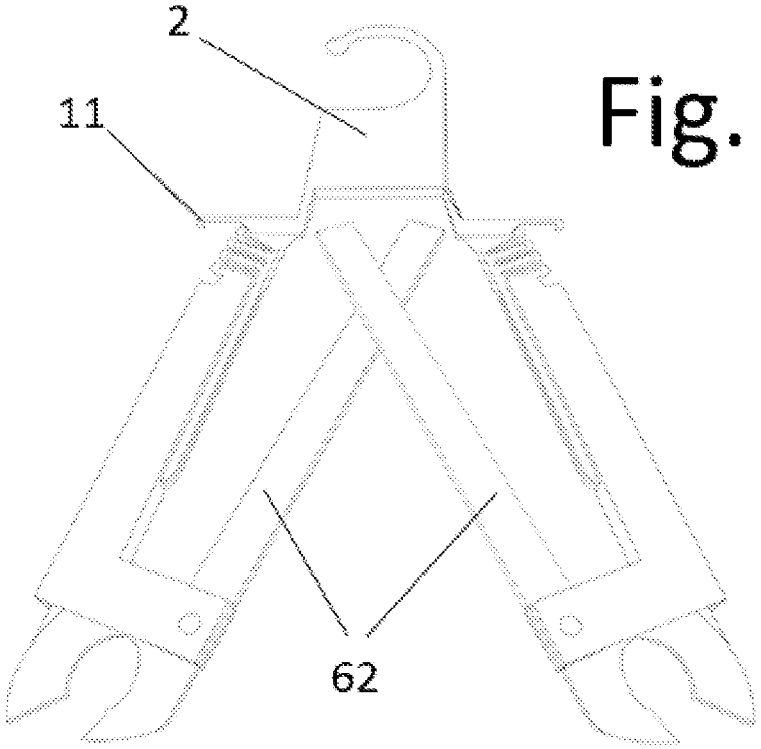
FIG. 7: View of the hanger in the extraction position, so that it can be removed through the neck of the corresponding garment.
Figure 8:
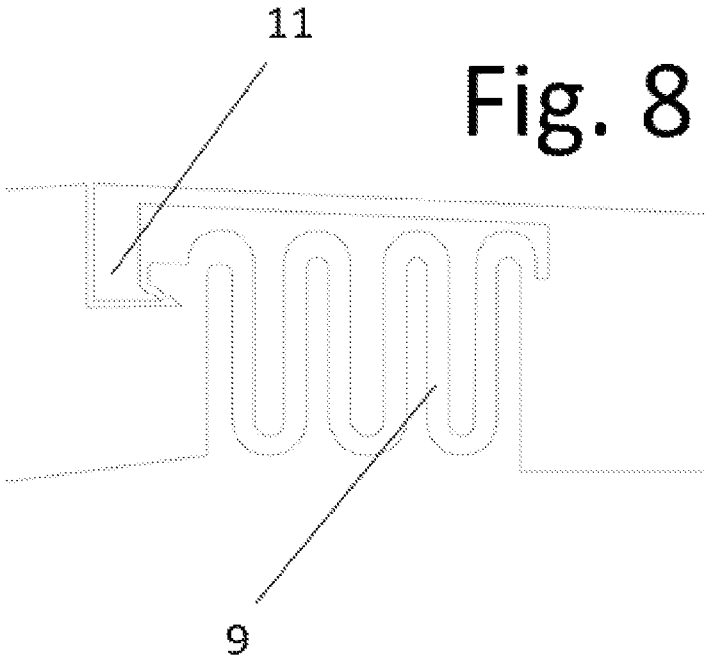
FIG. 8: Detail of a hinge showing the latch or stop.

Moreover, it has a base (8) which is articulated in both extensions (6), in the vertex of the corresponding "L", and which defines the general shape of the hanger, where the blouses, jackets, etc. will hang. This base (8) has second hinges (9), which are similar to the first hinges (4) of the support (1), so that their behaviour is similar. It is possible that only some hinges (4,9) have return springs. It should be noted that the arms (3) of the support (1) and the base (8) are very close or are superimposed in the folded position of the hanger, with the hinges (4,9) particularly close to each other. Thus, by using the hinges (4,9), it will be possible to make it take the form of FIG. 7 in order to remove the hanger from the inside of the shirt, blouse or garment, generally, through the neck.

Figure 6:
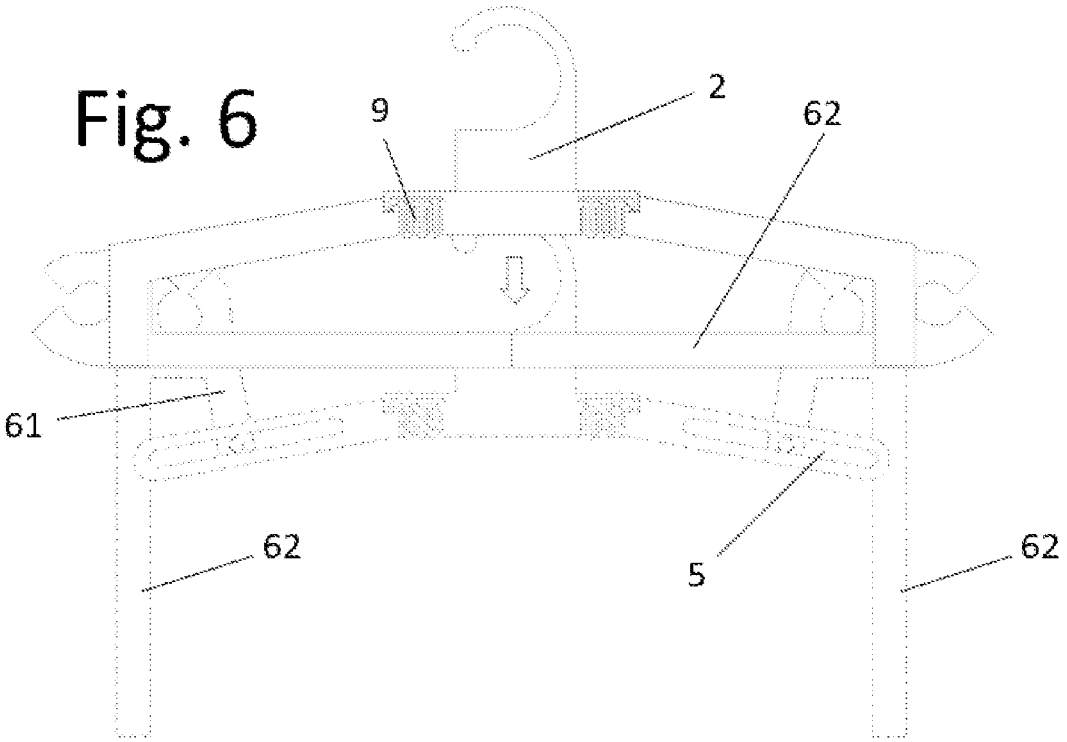
FIG. 6: Folded view of the hanger, the extended position being marked with a dotted line.

FIG. 6 shows the two most relevant positions of the elements of the hanger. In a first, folded, position, the hanger of the embodiment has a shape similar to a traditional hanger. In this position, the long sides (62) of the extensions (6) are approximately aligned. However, in the extended, or "template" position, represented by a dotted line, the extensions are rotated so that the long sides (62) of the "L" are parallel and separated by the width of the hanger. It can be seen that the base (8) is positioned above the support (1) and prevents the hanging hook (2) from protruding. For this purpose, the hanging hook (2) may have a guide groove (21) where a vertical protrusion (10) from the base (8) is positioned, facilitating controlled movement by pushing the base (8) and the hanging hook (2) against each other.

To move from one position to another, each extension (6) is rotated in its guide (5), and the corresponding movement of the base (8) which is always parallel to the support (1).

In the embodiment shown, the base (8) is formed by two parallel parts, one part formed by two parallel parts, one part corresponding to the front face (81) and a part corresponding to the rear face (82), which embrace the extensions (6) and allow the support (1) to pass through them. This is the preferred solution as it is the most resistant and reliable. The two faces (81,82) of the base (8) will be joined through the rotational axes of the extensions (6) and in areas where they do not enter into conflict with the movements of the extensions (6) or the support (1).

The hinges (4,9) of the embodiment shown comprise locking stops or latches (11) to prevent the hanger from bending under the weight of the hanger or from bending in the opposite direction. These latches (11) are particularly shown in the last figure.

The different parts will be preferably made of thermoplastic material, preferably recycled to minimise the CO2 footprint. Notwithstanding, the invention described here could be manufactured in other materials, whether of a natural origin such as wood or metal, chemical such as different plastics than those mentioned above, or alloys or combinations from either of the two groups.

The preferred manufacturing method will be by moulding and polishing, as well as bonding, where appropriate by welding, screwing, using an adhesive or other similar means.

The long side (62) of the extensions (6) are intended to hold trousers in the "hanger" position and serve as a folding guide in the "template" position. Therefore, the mechanisation of said elements is essential for the transformation of the element.

It is important to emphasise that, for those skilled in the art of manufacturing techniques and the mechanisation of elements, it will be evident that the mechanical aspects described herein, may easily be modified, obtaining similar results. It will be evident, therefore, that both the materials proposed, and the mechanical elements described could be modifications of those described herein, without changing the functionality and purpose of the hanger and template for folding and hanging items of clothing.

The invention claimed is:

1. A hanger for folding and hanging items of clothing, with two shoulders and a hanging hook which defines an upper part, which comprises two articulated lateral extensions at ends of the shoulders, each one with a long side, so that the hanger has:

a folded position wherein the long sides are aligned or superimposed;

and an extended position wherein the long sides are disposed parallel to each other;

wherein the hanger further comprises:

a flat support, attached to the hanging hook, and comprising two divergent arms featuring corresponding longitudinal guides; wherein each lateral extension is L-shaped with a short side whose extremity is movable along the corresponding guide and the long side; and a base, forming the two shoulders of the hanger, wherein the articulations of both lateral extensions are attached to the base; and the base is closer to the flat support in the folded position than in the extended position.

2. The hanger of claim 1, wherein the flat support has a first hinge on each side of the hanging hook and the base has second hinges coinciding with the first hinges in the folded position.

3. The hanger of claim 2, wherein the first hinges or the second hinges have a return spring.

4. The hanger of claim 2, wherein the first hinges or the second hinges have a locking stop or latch.

5. The hanger of claim 1, wherein each of the long sides of the lateral extension is equal to half a width of the hanger.

6. The hanger of claim 5, wherein ends of the long sides are finished off at an angle.

7. The hanger of claim 1, wherein the base has a protrusion that slides along a guide groove of the hanging hook to guide mutual displacement.

8. The hanger of claim 1, wherein the base is formed in two parts or faces, which embrace the lateral extensions and the flat support.

9. The hanger of claim 1, wherein each short side of the lateral extensions has an attachment for tapes or straps on an outer side.

10. The hanger of claim 1, wherein the hanger is made of thermoplastic material.

* * * * *